United States Patent [19]

Hutchins

[11] 4,124,321

[45] Nov. 7, 1978

[54] ADJUSTABLE TIE ROD HOLDER

[75] Inventor: Warwick B. Hutchins, Kew, Australia

[73] Assignee: B.B.R. Australia Pty. Ltd., Campbellfield, Australia

[21] Appl. No.: 784,827

[22] Filed: Apr. 5, 1977

[30] Foreign Application Priority Data

Apr. 6, 1976 [AU] Australia ..... 5507/76

[51] Int. Cl.[2] ..... F16B 9/00

[52] U.S. Cl. ..... 403/167; 403/369; 52/223 L

[58] Field of Search ..... 403/167, 168, 367, 368, 403/369, 373; 52/223 L, 224, 225, 227, 229, 703

[56] References Cited

U.S. PATENT DOCUMENTS

| | | | |
|---|---|---|---|
| 968,113 | 8/1910 | Bernard | 403/369 X |
| 987,431 | 5/1911 | Connors | 403/167 X |
| 2,947,409 | 8/1960 | Dodge et al. | 403/167 X |
| 3,117,485 | 1/1964 | Jansen | 403/369 X |
| 3,325,198 | 6/1967 | Cruse | 403/167 X |
| 3,327,380 | 6/1967 | Howlett | 403/369 X |
| 3,534,989 | 10/1970 | Yonkers | 403/369 |

*Primary Examiner*—Wayne L. Shedd
*Attorney, Agent, or Firm*—Dennison, Dennison, Meserole & Pollack

[57] ABSTRACT

A tie rod which is adapted to connect two constructional components of which at least at one end needs no modification of the wire or rod constituents the component of which has at least two conical members which can be associated with a member having an external thread which can pass over the conical members and cause them to lock on the rod and to enable pressure to be impressed thereon.

1 Claim, 6 Drawing Figures

10
11

19
20
17

16
18
14

33
32
34
21
30
31

15
24
22

23
13
12

ADJUSTABLE TIE ROD HOLDER

This invention relates to an improved tie rod and in particular to tie rods which have various uses such as holding walls, holding roofs to buildings, bracing and guying.

Tie rods of this type can advantageously beused in places where roofs need to be tied to calls, and/or walls need to be stressed to withstand, for example, cyclonic winds. They are also useful in general constructional and support areas.

There have previously been proposed tie rods for these purposes but as the height of the material through which they must pass varies these have been not fully satisfactory in that a large number of different sizes tie rods must be held, or specific length tie rods must be ordered for particular construction projects, or a relatively great length at the end of the tie rod must be threaded so that the rod can be used with wide variation of heights. Such threads can, if a large amount is exposed, tend to weaken the tie rod. Further, threaded rods are prone to damage during transport.

It is an object of the present invention to provide a tie rod the length of which can be readily adapted for different height structures and which, at the same time, is not weakened by threading.

It is also an object to provide a tie rod which is relatively cheap to manufacture.

The invention includes a tie rod having an expanded end and having associated therewith an externally threaded member having an internal bore adapted to pass over the tie rod and at least one wedge member, the lower end of which can enter the bore in the externally threaded member.

When the rod is located the externally threaded member is provided with a nut the arrangement being such that when the tie rod is positioned the externally threaded member is located at the upper surface of the structure and, preferably, passes into a counter-bored hole or the like in the structure, the wedge members are located in position above the externally threaded member and between the member and the tie rod and when the nut is tightened the externally threaded member is driven outwardly thereby locking on the wedge members so that tension can be provided to the structure.

In order that the invention may be more readily understood we shall describe one specific form of tie rod made in accordance with the invention, the specific form being illustrated in the accompanying drawings, in which.

Figures 1, 2, 3, 4, 5, 6:
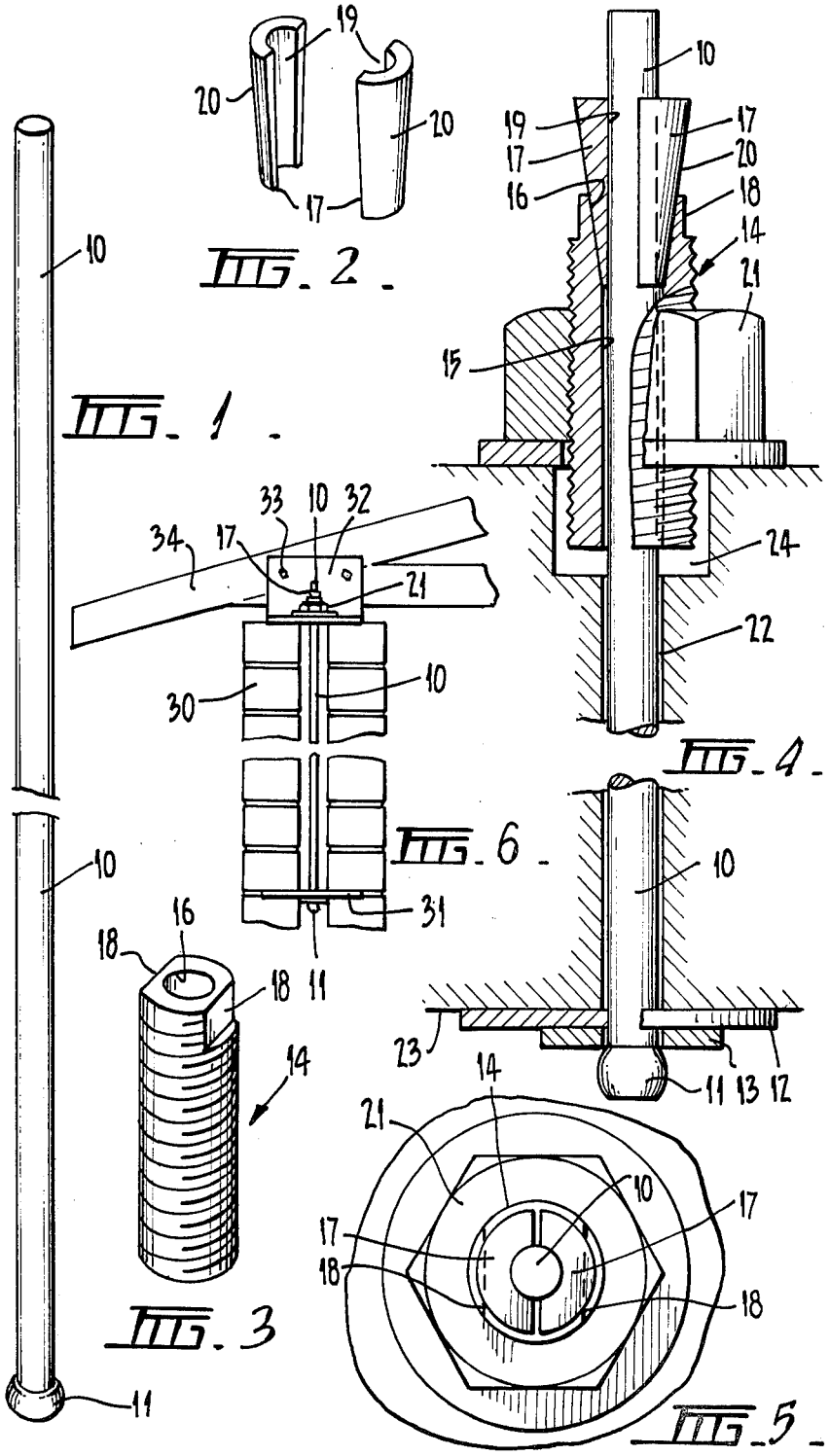
FIG. 1 is a broken view of the tie rod.
FIG. 2 shows, in perspective, the wedge grips.
FIG. 3 shows the externally threaded member.
FIG. 4 shows a section partly broken away of the assembly of the invention.
FIG. 5 shows a plan view of the assembly of FIG. 4.
FIG. 6 shows a specific application of the invention.

The tie rod 10 is preferably made of a high tensile wire and we prefer to use a 7 mm. diameter galvanised wire. Such wire has a minimum breaking load of 44.56k.N. Alternatively we can use a non-galvanised wire which has a breaking load of 65.42k.N. Of course, different diameter and breaking load wires could be used. One end of the tie rod is provided with a cold formed upset head 11 or, if required, may have a head formed thereon by welding or could be threaded to receive a nut or the like. When the rod is to be located we provide adjacent the head a washer 12 which may be of the order of 25mm. in diameter and may be hardened. In many applications and as illustrated we also provide a second washer 13 the size and shape of which depends on the actual application.

The tie rod 10 can be of any length depending on the type of structure with which it is used. The end of the tie rod away from the head 11 is not formed in any way.

Associated with the tie rod there is an externally threaded member 14 which may be made of 19mm. diameter high tensile free cutting steel rod. This threaded member has a bore 15 which is sufficient to enable it to be passed over the material of the tie rod 10. At one end the bore 15 of the threaded member is provided with a taper 16 which taper is to receive wedge grips 17, as will be described hereinafter.

At the end at which the taper is formed the externally threaded member is provided with machined flats 18 to enable it to be held against rotation.

A pair of wedge grips 17 are associated with the externally threaded member 14 and these each have a portion of a machined groove 19 to enable them to closely abut the external surface of the tie rod 10 and their external surfaces 20 are arcuate and adapted to enter the upper end of the taper 16 of the externally threaded member.

We also provide a nut 21 which is threaded to enable it to be fitted to the externally threaded member 14 and this nut may be of mild steel.

In use the tie rod passes through an aperture 22 in the wall or the like which is to be stabilised and the washer 12 or washers 12,13 adjacent the head 11 abut the lower surface 23 of the structure.

Depending upon the diameter of the aperture passing through the structure we may, at the upper end, form a counter-bore 24 which has a diameter sufficient to receive the externally threaded member 14.

The tie rod may then be cut to length, the externally threaded member either with or without the nut 21 attached is passed thereover and passed part way into the aperture in the structure.

The wedge grips 17 are then placed around the tie rod 10 and into the tapered portion 16 of the bore of the externally threaded member 14.

The nut is either then threaded onto the externally threaded member and/or is tightened while the externally threaded member is held against rotation by a spanner or the like against the flats 18 so that it comes in contact with the upper end of the structure. This tightening tends to move the externally threaded member outwardly, which means it moves towards the wedge grips and this movement tends to tighten the member against the wedge grip or grips.

Once this tightening is effected the externally threaded member becomes fixed relative to the tie rod and further tightening acts against the structure so that this may, if required, be post-tensioned.

The tie rod of the invention is, as indicated, suitable for post-tensioning masonry walls but also has a large number of other applications.

For example, FIG. 6 shows the use of a tie rod to tie a roof structure to its associated walls. Such an arrangement is particularly satisfactory for use in cyclonic zones.

In this arrangement the tie rod 10 is located in a wall 30. The tie rod may, as illustrated, be located by a washer or plate 31 which lies between two courses of bricks and its upper end passes through an aperture in an anchor plate 32 which is attached by bolts 33 or the like to the roof structure 34.

The arrangement of the tie rod is otherwise identical to that previously described. Alternatively the rod may extend from the bottom plate of the building through the anchor plate.

If required the lower end of the tie rod can be cast into a concrete block or can be located in a slotted member which itself may be cast into a concrete block. The tie rod of the invention can be used in other structural applications such as for cross-bracing sag rods or guying of light structures.

Also, if required, multiple tie rods can be used.

We have found that the arrangement of the invention permits a single length tie rod to be used with a wide range of structures, the only necessity being that a portion of the length of the tie rod may be cut off in some cases.

In an alternative arrangement not illustrated the material of the tie rod can be provided in a single coil and individual tie rods can be cut from the coil as desired. In these cases it is then necessary to form a head on one end either by deforming the end, cold forming it on the site or providing a protrusion as by locating a nut on the end or enlarging the end using welding electrodes or the like. In this way it is only necessary to supply the externally threaded member, the wedge grips and the nut and the contractor can make the intermediate portion of the tie rod to the required length.

I claim:

1. A tie rod for clamping a workpiece including a headed portion on one end and a substantially smooth walled portion of uniform size at the opposite end, a cylindrical sleeve member encircling the smooth walled portion of said tie rod and including an externally threaded body of substantially uniform diameter terminating at one end in at least a pair of oppositely disposed flat shoulders, an internal bore extending through said sleeve including a first portion complementary to said tie rod and a second portion extending outwardly from said complemental portion in conical configuration at said one end of said sleeve, wedge means complementary to said conical portion of said bore of said sleeve and including a portion dimensioned to embrace said tie rod and configured to grip said tie rod when said sleeve is moved relative to said tie rod and toward said wedge, rotatable tensioning means threaded on said sleeve and engaging one surface of said workpiece, said tensioning means upon rotation simultaneously applying clamping and tensioning forces to said tie rod to clamp said workpiece between the headed end portion of said tie rod and the rotatable tensioning means.

* * * * *